US012594456B2

(12) United States Patent
Lower

(10) Patent No.: US 12,594,456 B2
(45) Date of Patent: Apr. 7, 2026

(54) FREE WEIGHT WITH ROTATING HANDLE

(71) Applicant: Thomas Lower, Victor, ID (US)

(72) Inventor: Thomas Lower, Victor, ID (US)

( * ) Notice: Subject to any disclaimer, the term of this patent is extended or adjusted under 35 U.S.C. 154(b) by 46 days.

(21) Appl. No.: 18/630,724

(22) Filed: Apr. 9, 2024

(65) Prior Publication Data

US 2025/0058165 A1 Feb. 20, 2025

Related U.S. Application Data

(60) Provisional application No. 63/533,075, filed on Aug. 16, 2023.

(51) Int. Cl.
*A63B 21/00* (2006.01)
*A63B 21/072* (2006.01)

(52) U.S. Cl.
CPC ..... *A63B 21/4035* (2015.10); *A63B 21/0726* (2013.01); *A63B 21/4049* (2015.10)

(58) Field of Classification Search
CPC ..... A63B 21/4035; A63B 21/0726; A63B 21/4049
See application file for complete search history.

(56) References Cited

U.S. PATENT DOCUMENTS 2,676,802 A * 4/1954 O'Brien ..... A63B 21/0724 482/106
3,482,835 A * 12/1969 Dean ..... A63B 21/0724 482/110
4,103,887 A * 8/1978 Shoofler ..... A63B 21/0602 482/106
4,756,526 A * 7/1988 Broussard ..... A63B 21/0724 482/93
4,880,229 A * 11/1989 Broussard ..... A63B 21/0724 482/106
D306,332 S * 2/1990 Mayfield ..... D21/681
5,102,124 A * 4/1992 Diodati ..... A63B 21/0605 482/106
D481,771 S 11/2003 Anderson
D502,747 S 3/2005 Anderson
6,875,161 B1 * 4/2005 Brice ..... A63B 21/0728 482/107
7,182,715 B2 2/2007 Anderson
7,491,156 B1 * 2/2009 Gao ..... A63B 21/0724 482/106

(Continued)

FOREIGN PATENT DOCUMENTS

TW 599189 U 8/2020

OTHER PUBLICATIONS

"Black Iron Strength", Kettlebells, Available Online at: https://shop.blackironstrength.com/products/kettlebells#tabify-0, 7 pages.

(Continued)

*Primary Examiner* — Andrew S Lo
(74) *Attorney, Agent, or Firm* — Kilpatrick Townsend & Stockton LLP

(57) ABSTRACT

An exercise apparatus including an outer handle, a rod arranged to rotate within the outer handle, a first weight plate with an opening at an upper region, and a second weight plate with an opening at an upper region, where the first weight plate is attached to the rod by a first bolt and the second weight plate is attached to the rod by a second bolt.

17 Claims, 7 Drawing Sheets

(56) References Cited

U.S. PATENT DOCUMENTS

| | | | | |
|---|---|---|---|---|
| 7,883,452 | B1 | 2/2011 | Chen | |
| 7,887,469 | B1 * | 2/2011 | Chen | A63B 21/075 482/107 |
| 8,118,717 | B1 * | 2/2012 | Lai | A63B 21/0608 482/108 |
| 9,155,930 | B2 * | 10/2015 | Adkins | A63B 21/0724 |
| D744,051 | S | 11/2015 | Anderson | |
| D752,159 | S | 3/2016 | Anderson | |
| 9,364,703 | B1 * | 6/2016 | Kuka | A63B 21/0722 |
| 9,364,704 | B1 * | 6/2016 | Kuka | A63B 21/0722 |
| 9,533,183 | B1 * | 1/2017 | Khalil | A63B 21/0004 |
| D963,077 | S * | 9/2022 | Stearnes | D21/680 |
| 2007/0298939 | A1 * | 12/2007 | Anderson | A63B 21/0728 482/107 |
| 2013/0231225 | A1 * | 9/2013 | Shozda | A63B 21/075 482/108 |
| 2014/0274598 | A1 | 9/2014 | Anderson | |
| 2015/0038303 | A1 * | 2/2015 | Adkins | A63B 21/0726 482/108 |
| 2017/0319895 | A1 * | 11/2017 | Davis | A63B 23/1236 |
| 2023/0112052 | A1 | 4/2023 | Kravchenko | |
| 2023/0372763 | A1 * | 11/2023 | Pena | A63B 21/0728 |
| 2024/0226640 | A1 * | 7/2024 | Deshpande | A63B 21/0726 |

OTHER PUBLICATIONS

"Dynabell—Strength Training Rotating Handle & Multi Grip Dumbbell", Move Strong, Available Online at: https://www.movestrongfit.com/thedynabellinfo, Accessed from Internet on Apr. 8, 2022, pp. 1-13.

"Poliquin Kettlebell Handles:", Watson Gym Equipment, Available Online at: https://watsongym.co.uk/product/poliquin-kettlebell-handle/, Accessed from Internet on Apr. 8, 2022, pp. 1-6.

"Powertec Polyurethane Dumbbells—10 lb", Walmart, Available Online at: https://www.walmart.com/ip/Powertec-Polyurethane-Dumbbells-10-lb/507735656, Accessed from Internet on Apr. 8, 2022, pp. 1-4.

"Strength Equipment Crafted for Performance", Eleiko, Available Online at: https://www.eleiko.com/en/p/eleiko-evo-dumbbells-rotating/1837#gs.pa88se, Accessed from Internet on Apr. 8, 2022, pp. 1-7.

"Watson Pro Dumbbells", Watson Gym Equipment, Available Online at: https://watsongym.co.uk/product/watson-pro-dumbbells/, Accessed from Internet on Apr. 8, 2022, pp. 1-12.

"The U-Bell Abmat", Hybrid Kettlebell Abmat Custom Product Innovations, Available Online at: https://abmat.com/products/u-bell?variant=42848416825520, Accessed from Internet on Apr. 9, 2024, pp. 1-12.

* cited by examiner

FREE WEIGHT WITH ROTATING HANDLE

CROSS REFERENCE TO RELATED APPLICATION

This application claims the benefit of U.S. Provisional Application No. 63/533,075, filed Aug. 16, 2023, entitled "Free Weight with Rotating Handle and Offset Weights," the entire contents of which are incorporated herein by reference.

TECHNICAL FIELD

The present disclosure relates generally to exercises devices, and more particularly to free weights used individually or in pairs.

BACKGROUND

Dumbbells and kettlebells often include a handle that allows a user to grip the implement during exercises that build muscle and strength. These handles are typically fixed handles which require rotation within the hand of a user during use. Such rotation within the hand of a user may strain and put unnecessary pressure on the wrist of the user.

SUMMARY

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

A free weight with a rotating handle and offset weights is a revolutionary training tool that fulfills a significant need in the strength and conditioning, and physical rehabilitation markets. The free weight is uniquely designed to enable users to perform dynamic exercises more effectively, efficiently, and safely than with traditional free weights.

According to certain embodiments of the present disclosure, a free weight includes an outer handle; a rod arranged at least partially within the outer handle and configured to rotate within the outer handle; a first weight plate having a first opening at an upper region of the first weight plate; a second weight plate having a second opening at an upper region of the second weight plate; a first bolt configured to extend through the first opening to couple the first weight plate to a first end of the rod; and a second bolt configured to extend through the second opening to couple the second weight plate to a second end of the rod.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "up," "down," "top," "left," "right," "front," and "back," among others are intended to refer to the orientation as illustrated and described in the figure (or figures) to which the components and directions are referencing. References herein to "consisting of" may, in at least some circumstances, encompass "consisting essentially of" or "comprising."

Certain aspects and examples of the present disclosure relate to a free weight with a rotating handle that is displaced from a center of mass of the weights that the handle is connected to. Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

Figure 1:
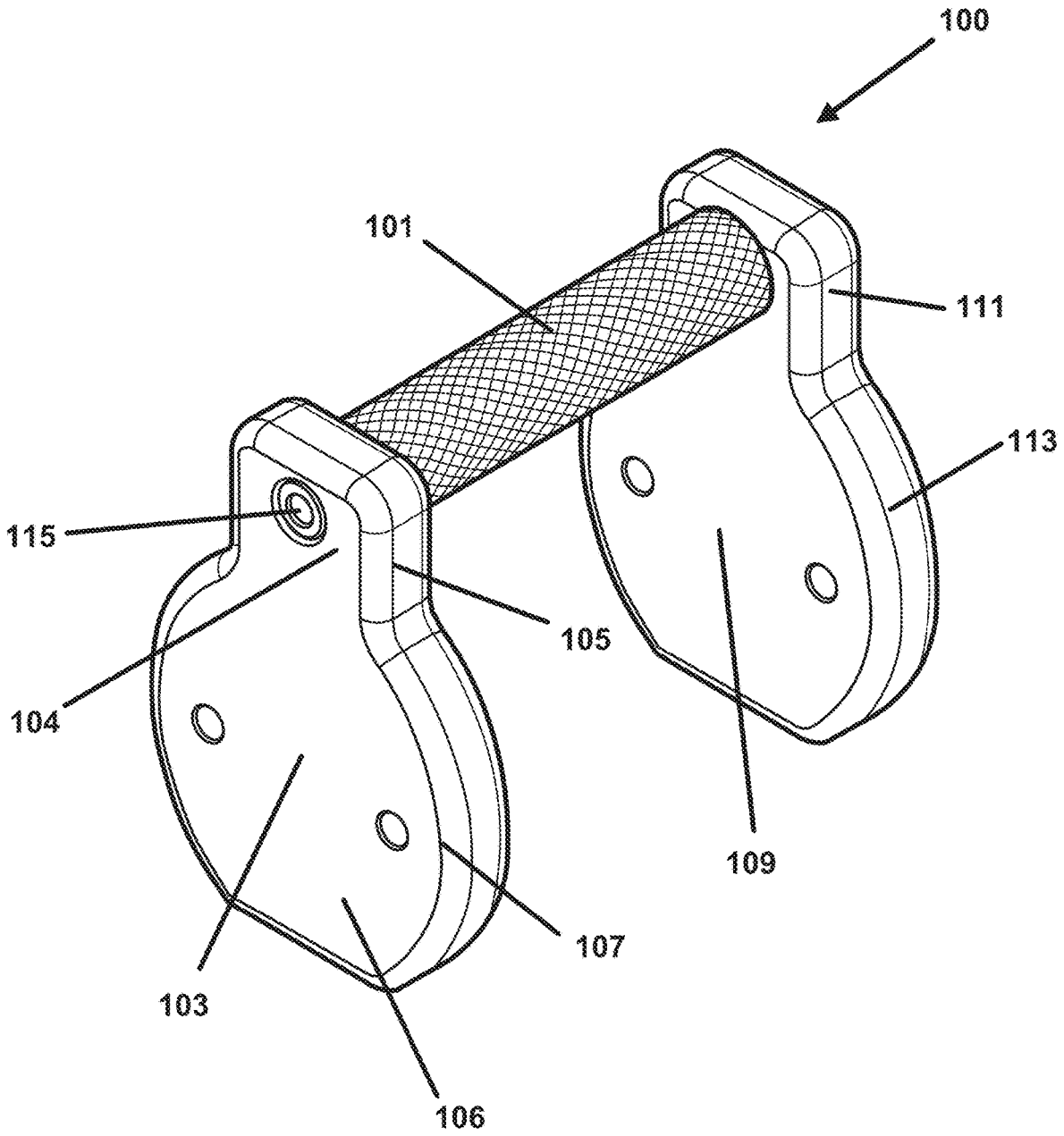
FIG. 1 is a perspective view of a free weight with a rotating handle according to certain embodiments.

FIG. 1 is a perspective view of a free weight 100 with a handle 101 according to certain embodiments of the present disclosure. The outer surface of the handle 101 may be knurled to improve a user's grip while performing various exercises. As described in further detail below with respect to FIG. 2, the handle 101 may surround a rod extending entirely, or at least partially, through the handle 101. The free weight 100 also includes a first weight plate 103 and a second weight plate 109, which may each be coupled to the rod arranged within the handle 101 by bolts, screws, or any other suitable fastener (e.g., bolt 115). The first weight plate 103 includes an upper region 105 and a lower region 107. The second weight plate 109 also includes an upper region 111 and a lower region 113.

The first bolt 115 extends through a first opening in the upper region 105 and couples the upper region 105 of the first weight plate 103 to a first end of the rod arranged within the handle 101 and the second bolt 215 (discussed in further detail below with respect to FIG. 2) extends through a second opening in the upper region 111 and couples the upper region 111 of the second weight plate 109 to a second end of the rod arranged within the handle 101.

At least a portion of the upper region 105 of the first weight plate 103 is aligned with a longitudinal axis extending through the handle 101, and at least a portion of the upper region 111 of the second weight plate 109 is also aligned with the longitudinal axis extending through the handle 101. In some embodiments, the lower region 107 may be vertically aligned with the upper region 105, and the lower region 113 may be vertically aligned with the upper region 111. For example, the upper region 105 may include a first face surface 104 and the lower region 107 may include a second face surface 106. The first face surface 104 and the second face surface 106 may be vertically aligned and parallel with one another. In some embodiments, the lower region 107 of the first weight plate 103 is oriented to mirror the lower region 113 of the second weight plate 109. The first weight plate 103 and the second weight plate 109 are arranged perpendicular to the rod and the handle 101.

The first bolt 115 may be flush with the first face surface 104, and the second bolt 215 may be flush with a third face surface of the second weight plate 109, where the upper region 111 includes the third face surface. In some embodiments, the lower region 107 of the first weight plate 103 includes a resting surface that extends parallel to the handle 101, and the lower region 113 of the second weight plate 109 also includes a resting surface parallel to the handle 101. The upper region 105 of the first weight plate 103 may be distanced from a center of mass of the first weight plate 103, which is arranged off-center from the handle 101. The upper region 111 of the second weight plate 109 may be distanced from a center of mass of the second weight plate 109, which is arranged off-center from the handle 101.

Figure 5:
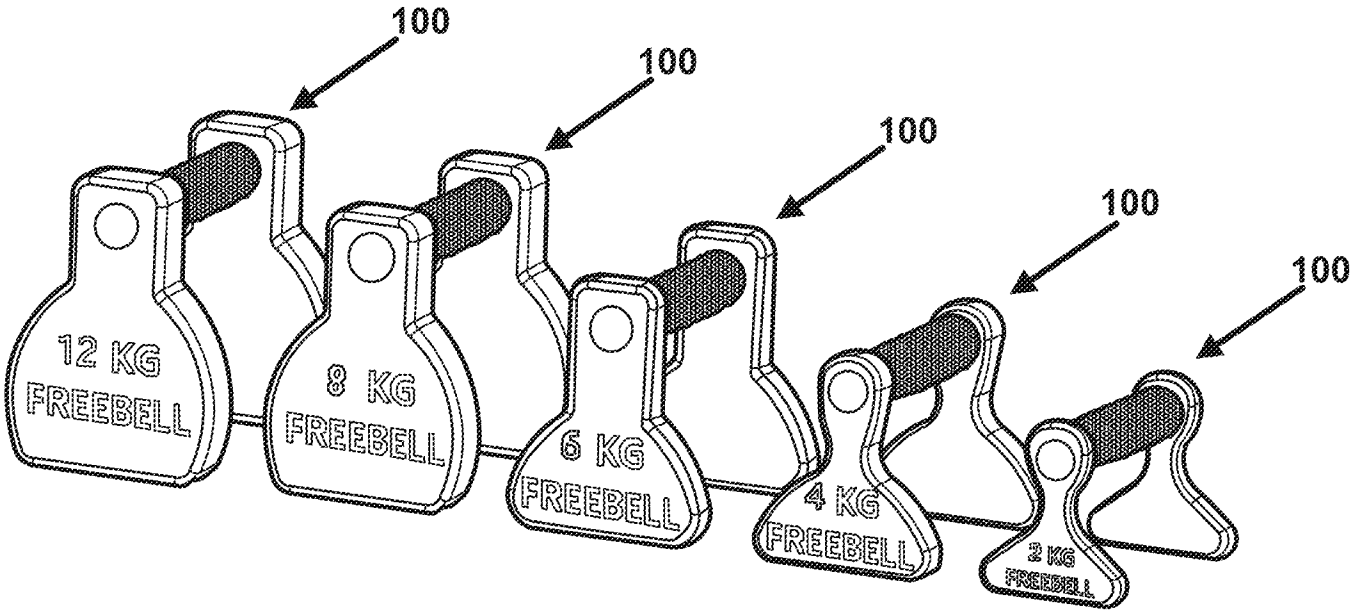
FIG. 5 is a perspective view of multiple free weights of different masses according to certain embodiments.

The off-centered arrangement of the center of mass of both the first weight plate 103 and the second weight plate 109 creates an uneven weight distribution under the handle 101. In some embodiments, as shown in FIG. 5, the mass of the free weight 100 may be fixed. However, the mass of each free weight 100 is designed to be distributed proportionally about the handle 101 as the mass increases. Thus, any movement of the free weight 100 may be consistent even as the mass increases.

The entire free weight 100 can be made of a hard material such as steel, metal or plastic material. In some embodiments, the different elements of the free weight 100 may be formed of different material. For example, the first weight plate 103 and the second weight plate 109 may be formed from steel, the rod may be formed from another metal material, and the handle 101 may be formed from a plastic material. All parts can be solid or hollow on the inside.

Figure 6:
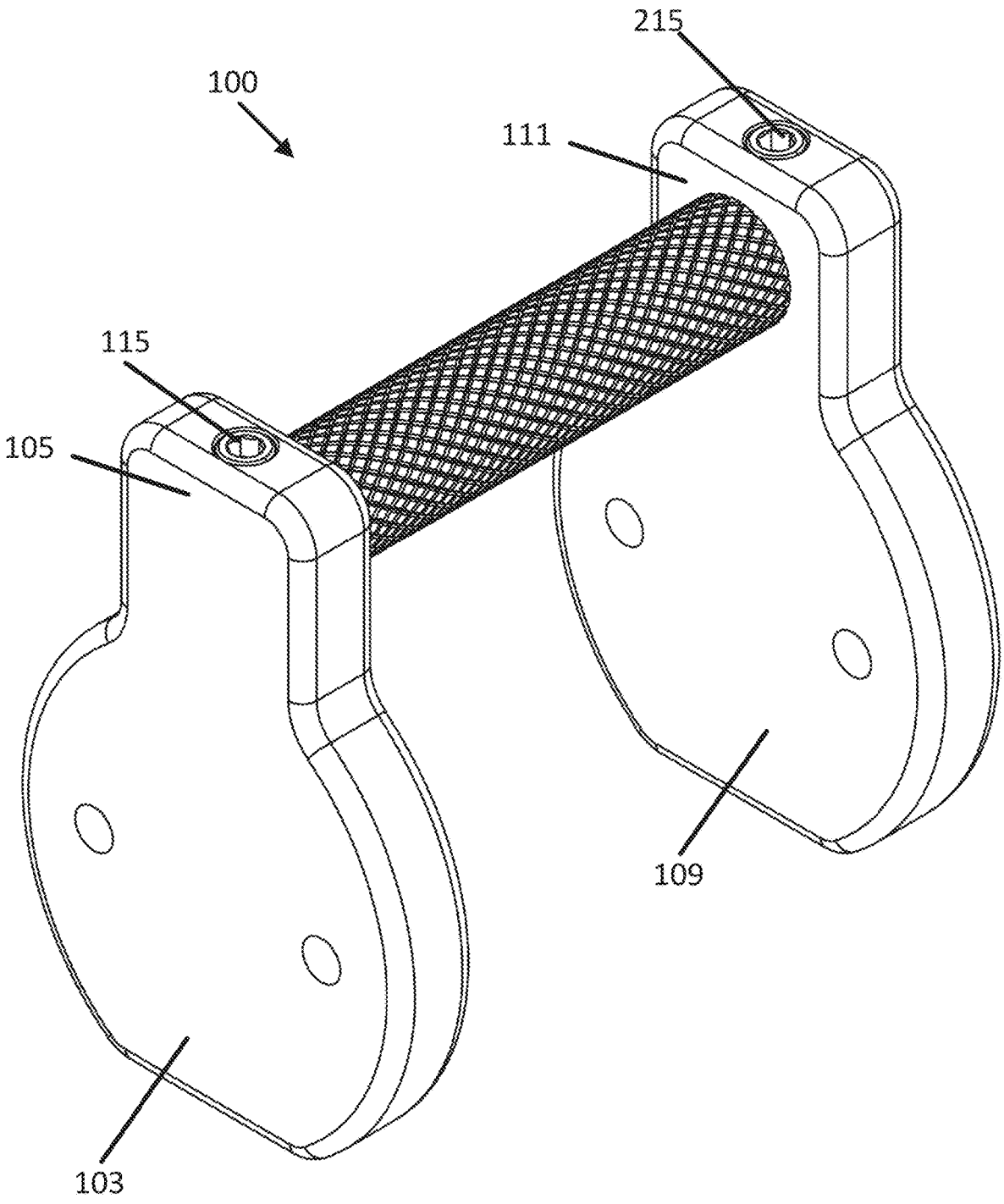
FIG. 6 is a perspective view of a free weight with a rotating handle according to certain embodiments.
Figure 7:
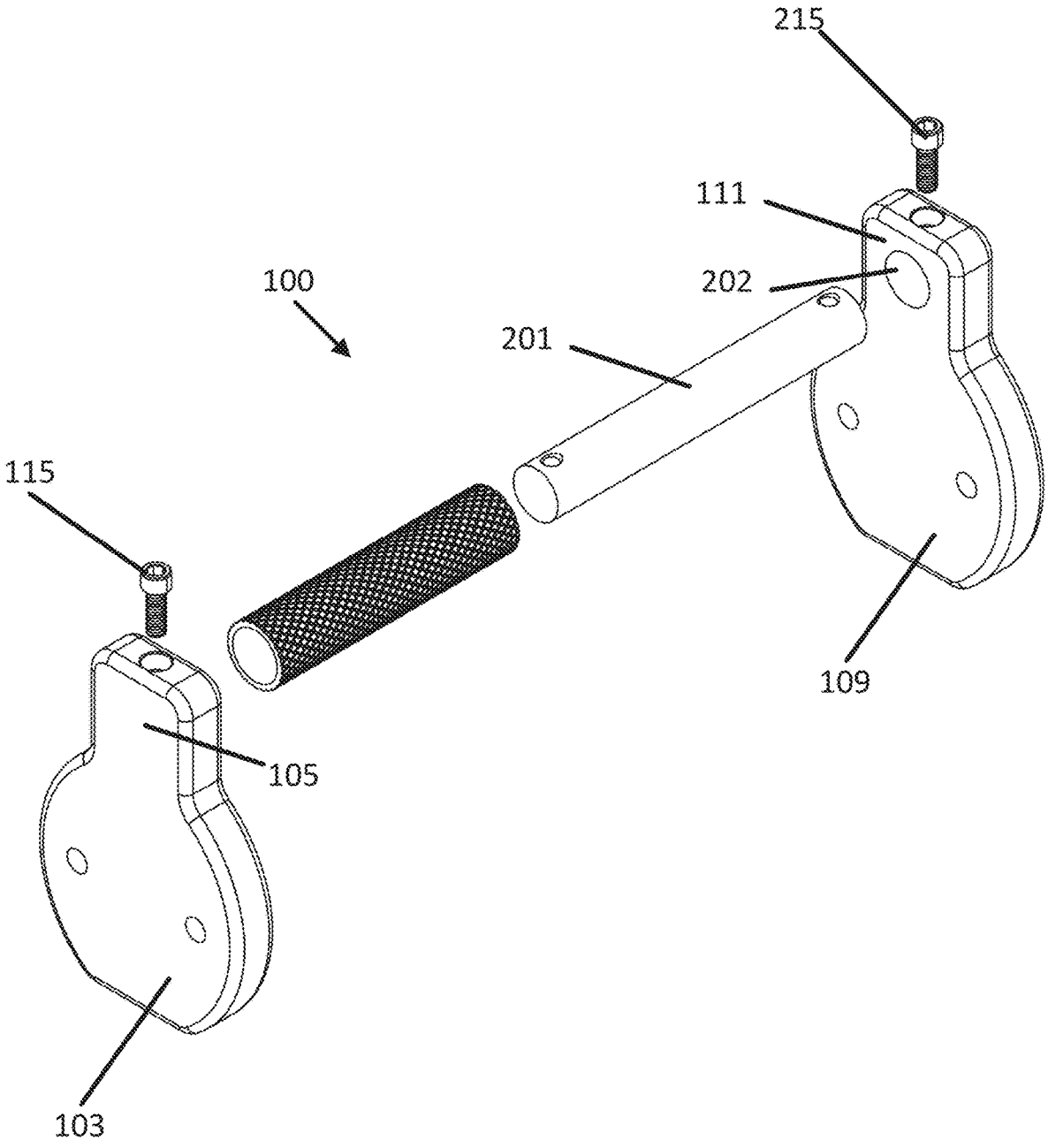
FIG. 7 is an exploded, perspective view of the free weight of FIG. 6.

In some embodiments, for example as shown in FIGS. 6 and 7, the free weight 100 may include a first opening in the upper region 105 and a second opening in the upper region 111 that are each arranged on an upper surface of the respective first weight plate 103 and the second weight plate 109 such that the openings and first bolt 115 and second bolt 215 may extend vertically through the upper regions 105, 111.

Further, the first weight plate 103 and the second weight plate 109 may each include at least one recess 202 into which an end of the rod 201 may be inserted. In some embodiments, e.g., FIG. 2, the shape of the ends of the rod 201 correspond with the shape of the at least one recess 202 of the respective weight plate 103, 109 such that the ends of the rod 201 mate with the at least one recess 202 of the respective weight plate 103, 109 and are prevented from rotating relative to the respective weight plate 103, 109. In further embodiments, e.g., FIG. 7, the ends of the rod 201 may be inserted into the at least one recess 202 of the respective weight plate 103, 109 and the first or second bolt 115, 215 may extend vertically and at least partially through the corresponding end of the rod 201 to prevent rotation of the rod 201 relative to each weight plate 103, 109.

The first bolt 115 and the second bolt 215 may extend through the upper regions 105, 111 of the respective first weight plate 103 and the second weight plate 109 and through threaded holes in the ends of the rod 201 to secure the first weight plate 103 and the second weight plate 109 to the rod 201. In some embodiments, the first bolt 115 and the second bolt 215 may extend at least partially through the respective ends of the rod 201 and may extend perpendicular to a longitudinal axis extending through the rod 201. The arrangement of the first bolt 115 and the second bolt 215 may prevent the first weight plate 103 and the second weight plate 109 from rotating relative to each other.

Figure 2:
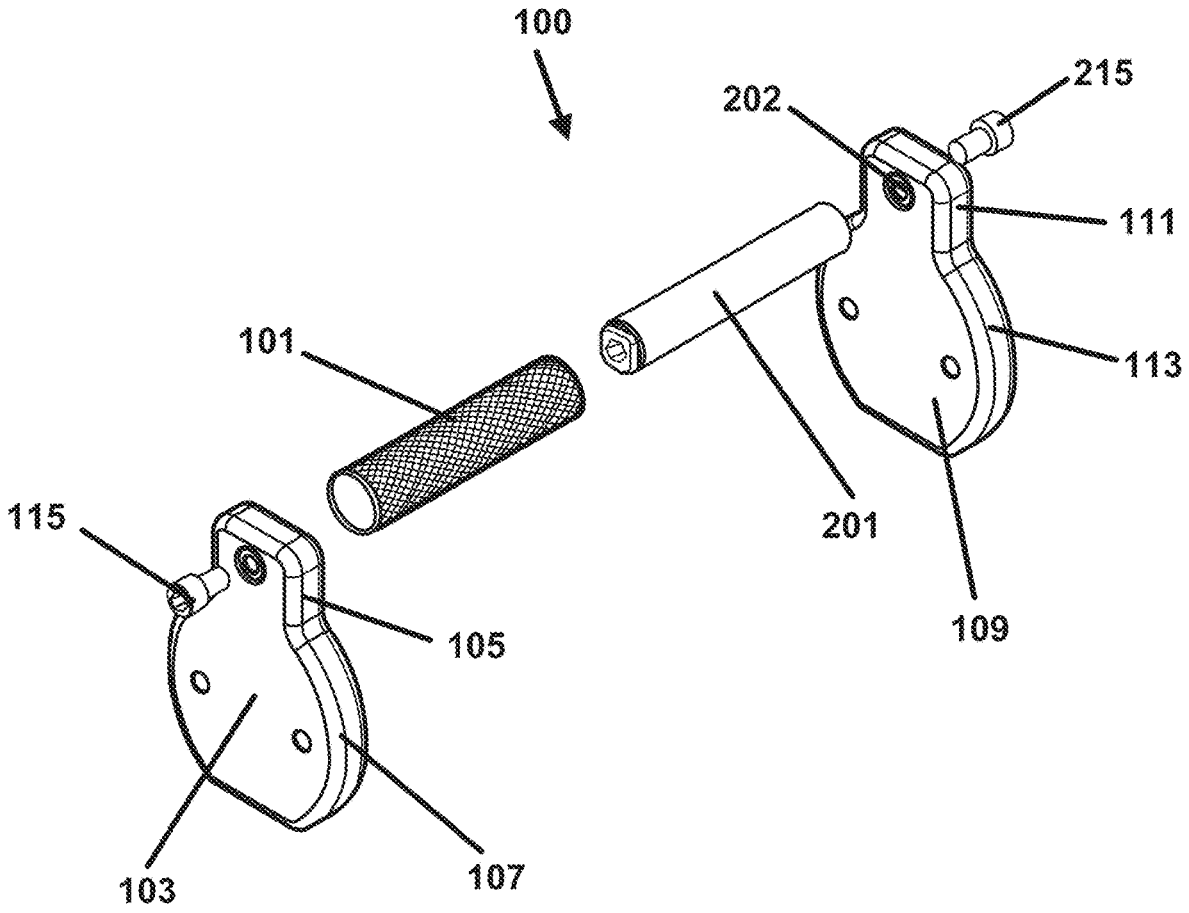
FIG. 2 is an exploded, perspective view of the free weight of FIG. 1.

FIG. 2 is an exploded, perspective view of the free weight 100 of FIG. 1 according to certain examples. The rod 201 may extend at least partially, and in some embodiments entirely, along the length of the handle 101 and is disposed within the handle 101. The rod 201 may include a third opening at the first end of the rod and a fourth opening at the second end of the rod, which may both be threaded. The rod 201 is coupleable to the upper region 105 of the first weight plate 103 by the first bolt 115 extending at least partially through the first opening in the upper region 105 and the second opening in the rod 201. The rod 201 is coupleable to the upper region 111 of the second weight plate 109 by the second bolt 215 extending at least partially through the second opening in the upper region 111 and the fourth opening in the rod 201.

The handle 101 may rotate freely around the rod 201. In some examples, a plurality of needle bearings and/or a plurality of roller bearings may be disposed between the rod 201 and the handle 101 to reduce the friction of handle 101 rotating about the rod 201. The first weight plate 103 and the second weight plate 109 are not rotatable relative to the rod 201. Therefore, the first weight plate 103, the second weight plate 109, and the rod 201 are rotatable as a single unit relative to the handle 101 such that the first weight plate 103 and the second weight plate 109 are rotatable relative to the handle 101. This rotation allows the user to maintain control of the handle 101 while the free weight 100 rotates, creating a safe and controlled rotation. Such rotation combined with the off-centered center of mass of the first weight plate 103 and the second weight plate 109 introduces an element of rotational movement and instability when a user uses the free weight 100, which may engage more muscles as the user's body works to stabilize the movement, which challenges the user's muscles in different ways than a standard fixed dumbbell.

Further, the arrangement of the first weight plate 103 and the second weight plate 109 on opposite ends of the handle 101 enables a more unrestricted 360-degree rotation of the first weight plate 103 and the second weight plate 109 around the handle 101 than a standard kettlebell design, where there is a single weighted portion arranged directly below and connected to both ends of the handle, would as the weight's placement might limit the range of movement. Such arrangement of first weight plate 103 and the second weight plate 109 on opposite ends of the handle 101 also enables a wide variety of exercises and movement patterns.

Users using the free weight 100 can manipulate their bodies through a wide range of motion without being constrained by the weights themselves. Thus, the free weight 100 can lead to more dynamic and varied workouts that engage different muscle groups and challenge the body in new ways.

The free weight 100 is engineered in a compact, user friendly design that allows the user to move freely in a variety of complex and dynamic movements. The physics were engineered proportionally to create a smooth rotation of the handle 101 in comparison to the load distributed below the handle 101.

Figure 3:
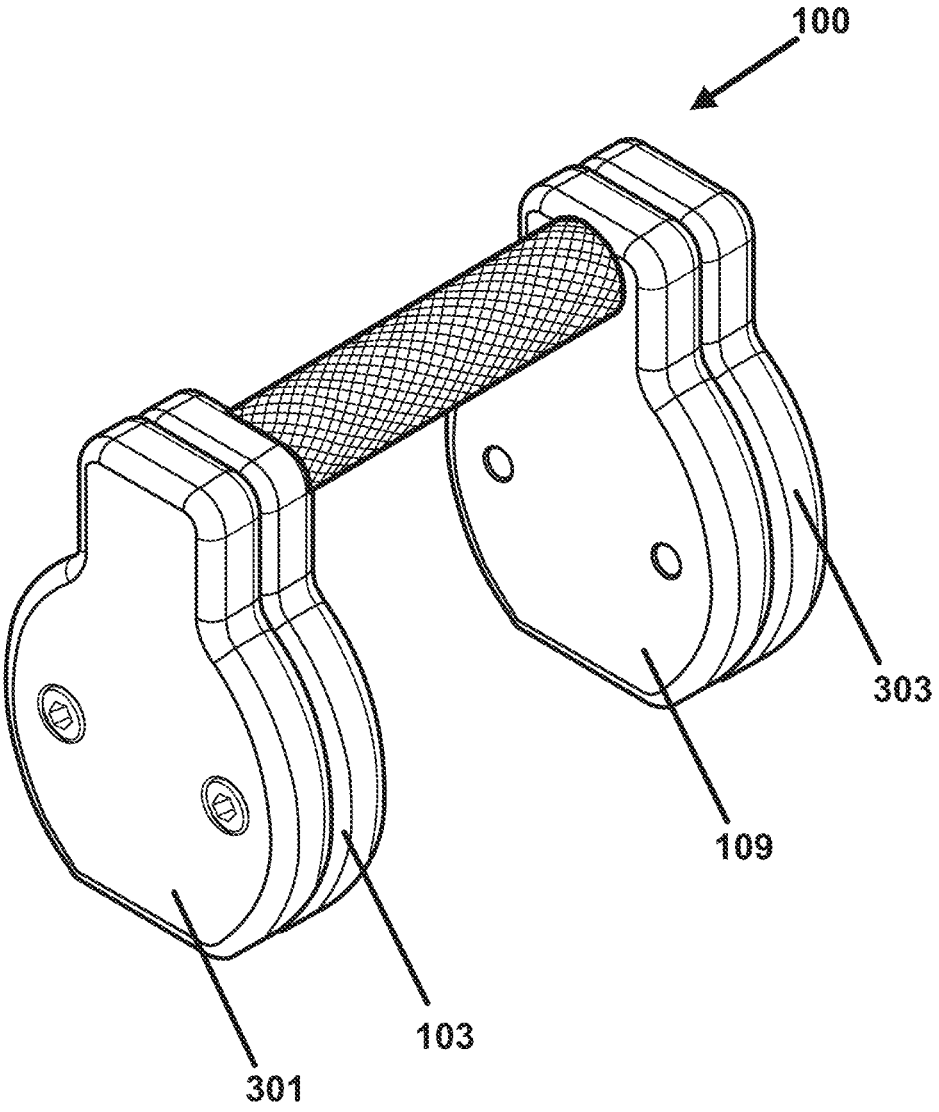
FIG. 3 is a perspective view of the free weight of FIG. 1 with additional weight plates.

FIG. 3 is a perspective view of the free weight 100 of FIG. 1 with additional weight plates according to certain examples of the present disclosure. The free weight 100 may include additional weight plates that enable a user to customize the overall weight of the free weight 100. For example, the free weight 100 may include a third weight plate 301 coupleable to the first weight plate 103 and/or the rod 201 and a fourth weight plate 303 coupleable to the second weight plate 109 and/or the rod 201. In some embodiments, increasing the size of the first weight plate 103 and the second weight plate 109 may increase the overall weight of the free weight 100. In further embodiments, the first weight plate 103 and the second weight plate 109 may each be replaced with different weight plates to enable a user to adjust and customize the overall weight of the free weight 100.

Figure 4:
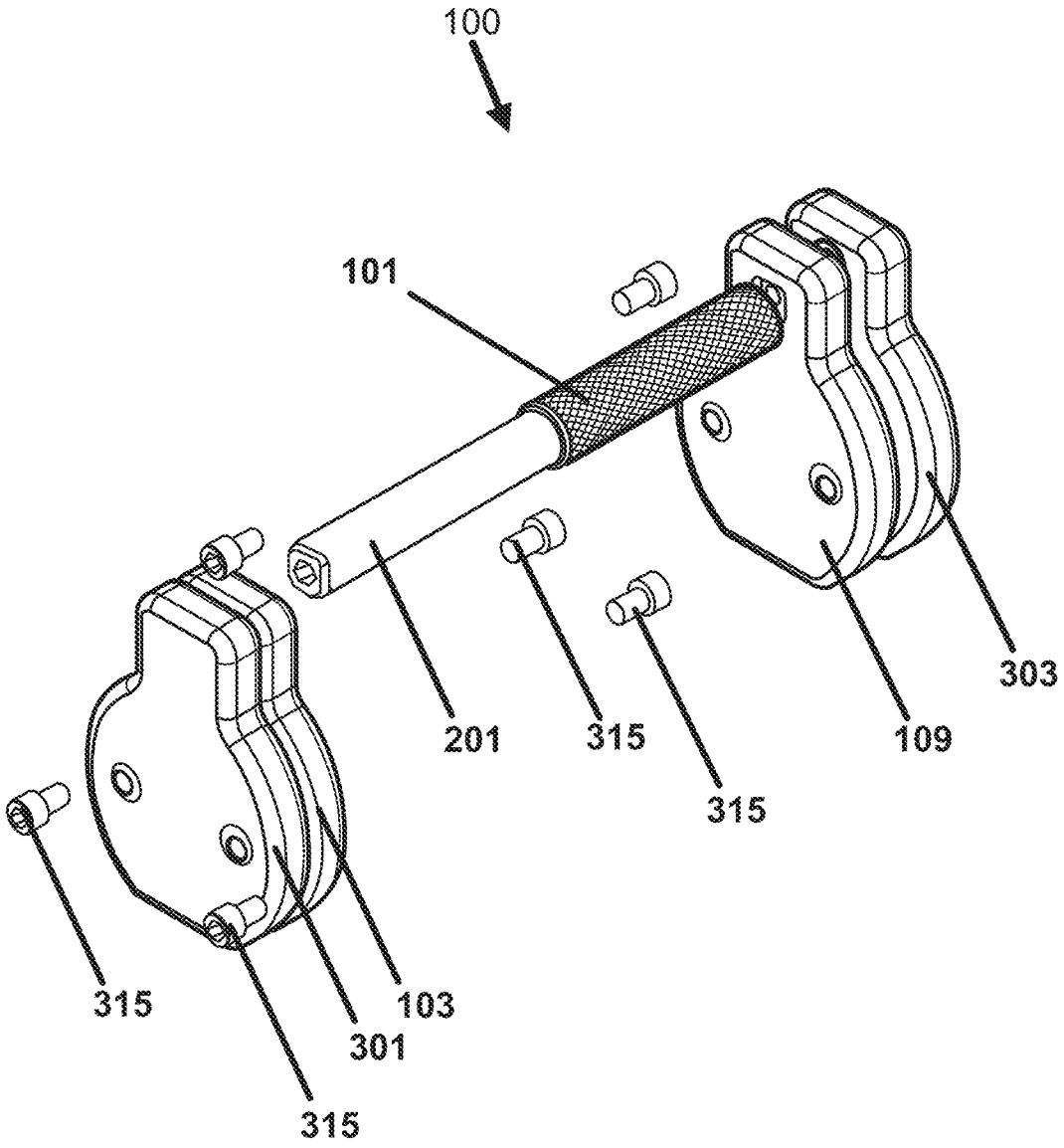
FIG. 4 is an exploded, perspective view of the free weight of FIG. 3.

FIG. 4 is an exploded, perspective view of the free weight 100 of FIG. 3 with the additional weight plates according to certain examples of the present disclosure. The lower regions of each of the first weight plate 103 and the third weight plate 301 may each include at least one opening. The at least one opening in each of the lower regions of each of the first weight plate 103 and the third weight plate 301 may correspond with one another such that at least one bolt 315 may extend through each of the at least one opening in each of the lower regions of each of the first weight plate 103 and the third weight plate 301 to couple the third weight plate 301 to the first weight plate 103. Similarly, the lower regions of each of the second weight plate 109 and the fourth weight plate 303 may each also include at least one opening. The at least one opening in each of the lower regions of each of the second weight plate 109 and the fourth weight plate 303 may correspond with one another such that at least one bolt 315 may extend through each of the at least one opening in each of the lower regions of each of the second weight plate 109 and the fourth weight plate 303 to couple the second weight plate 109 to the fourth weight plate 303.

In other examples, alternative numbers and placement of openings for coupling the third weight plate 301 to the first weight plate 103 and the second weight plate 109 to the fourth weight plate 303 are also possible. The openings for coupling the third weight plate 301 to the first weight plate 103 and the second weight plate 109 to the fourth weight plate 303 may be threaded.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. An exercise apparatus comprising:

an outer handle having a longitudinal axis;

a rod arranged at least partially within the outer handle and configured to rotate within the outer handle;

a first weight plate comprising a first plate opening at an upper region of the first weight plate;

a second weight plate comprising a second plate opening at an upper region of the second weight plate;

a first bolt configured to extend through the first plate opening to couple the first weight plate to a first end of the rod; and a second bolt configured to extend through the second plate opening to couple the second weight plate to a second end of the rod, wherein each of the first weight plate and the second weight plate is a monolithic plate having a fixed mass, and wherein a center of mass of each of the first weight plate and the second weight plate is arranged off-center from the outer handle.

2. The exercise apparatus of claim 1, further comprising at least one bearing disposed between the rod and the outer handle.

3. The exercise apparatus of claim 1, wherein a lower region of the first weight plate is configured to mirror a lower region of the second weight plate.

4. The exercise apparatus of claim 1, wherein a lower region of the first weight plate comprises a resting surface that extends parallel to the outer handle and a lower region of the second weight plate comprises a resting surface that extends parallel to the outer handle.

5. The exercise apparatus of claim 1, wherein the upper region of the first weight plate is distanced from the center of mass of the first weight plate, and the upper region of the second weight plate is distanced from the center of mass of the second weight plate.

6. The exercise apparatus of claim 1, wherein the upper region of the first weight plate is aligned with the longitudinal axis of the outer handle and the upper region of the second weight plate is aligned with the longitudinal axis of the outer handle.

7. The exercise apparatus of claim 1, wherein the first weight plate and the second weight plate are not rotatable relative to the rod.

8. The exercise apparatus of claim 1, wherein the first weight plate and the second weight plate are rotatable relative to the outer handle.

9. The exercise apparatus of claim 1, wherein the first weight plate and the second weight plate are arranged perpendicular to the rod and the outer handle.

10. The exercise apparatus of claim 1, wherein the first plate opening and the second plate opening are threaded.

11. The exercise apparatus of claim 1, wherein the rod comprises a first rod opening and a second rod opening, the first rod opening and the second rod opening each being threaded.

12. The exercise apparatus of claim 2, wherein the at least one bearing comprises at least one of a needle bearing or a roller bearing.

13. The exercise apparatus of claim 1, wherein the first bolt is configured to extend vertically through the first plate opening and wherein the second bolt is configured to extend vertically through the second plate opening.

14. The exercise apparatus of claim 1, wherein the first weight plate further comprises a threaded additional opening in a lower region of the first weight plate and wherein the exercise apparatus further comprises a third weight plate and at least one fastener extending through the threaded additional opening of the first weight plate to secure the third weight plate to the first weight plate.

15. An exercise apparatus comprising:

an outer handle;

a rod arranged at least partially within the outer handle and configured to rotate within the outer handle;

a first weight plate comprising a first opening at an upper region of the first weight plate;

a second weight plate comprising a second opening at an upper region of the second weight plate;

a first bolt configured to extend through the first opening to couple the first weight plate to a first end of the rod; and a second bolt configured to extend through the second opening to couple the second weight plate to a second end of the rod, wherein the first bolt is configured to couple a third weight plate to the first end of the rod and the second bolt is configured to couple a fourth weight plate to the second end of the rod.

16. An exercise apparatus comprising:

an outer handle;

a rod arranged at least partially within the outer handle and configured to rotate within the outer handle;

a first weight plate comprising a first opening at an upper region of the first weight plate;

a second weight plate comprising a second opening at an upper region of the second weight plate;

a first bolt configured to extend through the first opening to couple the first weight plate to a first end of the rod; and a second bolt configured to extend through the second opening to couple the second weight plate to a second end of the rod, wherein the first weight plate comprises a third opening adapted to receive a third bolt to couple a third weight plate to the first weight plate and the second weight plate comprises a fourth opening adapted to receive a fourth bolt to couple a fourth weight plate to the second weight plate.

17. An exercise apparatus comprising:

an outer handle;

a rod arranged at least partially within the outer handle and configured to rotate within the outer handle;

a first weight plate comprising a first opening at an upper region of the first weight plate;

a second weight plate comprising a second opening at an upper region of the second weight plate;

a first bolt configured to extend through the first opening to couple the first weight plate to a first end of the rod; and a second bolt configured to extend through the second opening to couple the second weight plate to a second end of the rod, wherein the first bolt is flush with an outside surface of the first weight plate and the second bolt is flush with an outside surface of the second weight plate.

* * * * *